US007506600B2

(12) United States Patent
Furuya et al.

(10) Patent No.: US 7,506,600 B2
(45) Date of Patent: Mar. 24, 2009

(54) WATERBORNE VEHICLE

(75) Inventors: Kentaro Furuya, Wako (JP); Toyokazu Kawasaki, Wako (JP); Haruhiko Okawa, Wako (JP); Tatsuya Kuroda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/864,131

(22) Filed: Sep. 28, 2007

(65) Prior Publication Data

US 2008/0078317 A1 Apr. 3, 2008

(30) Foreign Application Priority Data

Sep. 29, 2006 (JP) ..... 2006-268689
Sep. 29, 2006 (JP) ..... 2006-268772
Sep. 29, 2006 (JP) ..... 2006-268834
Sep. 29, 2006 (JP) ..... 2006-268891

(51) Int. Cl.
*B63H 25/04* (2006.01)

(52) U.S. Cl. ..... 114/144 R; 440/53

(58) Field of Classification Search ..... 114/55.54, 114/55.56, 144 R; 440/53
See application file for complete search history.

(56) References Cited

U.S. PATENT DOCUMENTS 2,840,832 A * 7/1958 Fried ..... 114/55.54
3,171,383 A * 3/1965 Abelow ..... 114/55.56
7,189,127 B2 * 3/2007 Otobe et al. ..... 440/53

FOREIGN PATENT DOCUMENTS

JP 2005280627 A 10/2005

* cited by examiner

*Primary Examiner*—Lars A Olson
(74) *Attorney, Agent, or Firm*—Westerman, Hattori, Daniels & Adrian, LLP.

(57) ABSTRACT

A waterborne vehicle having a steering mechanism for transmitting a tilt of a hull and steering a propulsion apparatus. The steering mechanism comprises a first operation element for transmitting the tilt of the hull, and a second operation element that is connected to the first operation element, and that converts into steerage the tilt of the hull transmitted by the first operation element.

6 Claims, 14 Drawing Sheets

WATERBORNE VEHICLE

FIELD OF THE INVENTION

The present invention relates to a powered waterborne vehicle that is provided with a propulsion apparatus composed of an outboard motor or the like in a hull composed of a surfboard or the like.

BACKGROUND OF THE INVENTION

A powered waterborne vehicle can be obtained in a simple manner by mounting an outboard motor on the unpowered hull of a surfboard or the like. However, a limitation is imposed on the posture of the rider in turning the hull when the rider manually operates the steering lever of the outboard motor. There is a need for the rider to ride the hull with a free posture.

In view of this need, a waterborne vehicle in which the hull can be turned by merely tilting the hull is disclosed in JP 2005-280627 A. This waterborne vehicle will be described with reference to FIGS. 13 to 15 hereof.

A pipe frame 102 is disposed on a hull 100 via a suction cup 101, as shown in FIG. 13. A stern board 103 is integrally mounted on the pipe frame 102. A spindle 105 is rotatably mounted in the horizontal direction on the stern board 103 via a bearing 104. A propulsion apparatus support board 106 that supports a propulsion apparatus is mounted and fixed on the spindle 105 using a sleeve 107 and a bolt 108. A stern bracket 111 of the propulsion apparatus 110 is mounted on the propulsion apparatus support board 106. A stay pipe 112 extends downward from the propulsion apparatus support board 106, and a float 113 is provided to the lower end of the stay pipe 112. When the float 113 is floating on still water, the propulsion apparatus support board 106 and the spindle 105 remain stationary due to the support effect of the float 113. As a result, the stern board 103, the pipe frame 102, and the hull 100 can be rotated about the spindle 105.

A Z-shaped support metal fitting 114, as viewed from the side surface, extends upward from the sleeve 107, a pin 115 is disposed in the upper portion of the support metal fitting 114, and a pivot rod 116 is pivotably disposed on the pin 115 in the front and back directions in relation to the diagram. A hole 117 is provided in the upper portion of the pivot rod 116 supported by the pin 115. A pin 118 that extends from the propulsion apparatus 110 is inserted into the hole 117. The lower portion of the pivot rod 116 is connected to the stern board 103 via a connection fitting 119 and a pin 121.

The movement of the pivot rod 116 is transmitted to the propulsion apparatus 110 by way of the pin 118. At this time, a steering shaft 122 that is disposed completely through the stern bracket 111 in the vertical direction rotates, and a propeller 123 in the lowermost position moves in the front and back directions in relation to the diagram.

In other words, a pin 121 moves to the left from the neutral axis 124 in the diagram when the hull 100 is tilted in the clockwise direction of the diagram, as shown in FIG. 14. At this time, the pivot rod 116 rotates about a pin 115 in the clockwise direction of the diagram. Next, the propulsion apparatus 110 rotates in the manner indicated by the arrow (1), and the propeller 123 also turns in the manner indicated by the arrow (1).

In this manner, the rider tilts the hull 100 while simultaneously turning the propulsion apparatus 110.

In order to coordinate these actions, the support metal fitting 114, pin 115, and pivot rod 116 are essential, and a mechanism for achieving this coordination is complicated and leads to increased assembly hours of the waterborne vehicle and higher manufacturing costs. Additionally, movement is liable to deteriorate due to rusting and soiling when such a complicated mechanism is provided to a waterborne vehicle that is exposed to salt water and fresh water. The vehicle must be frequently disassembled and cleaned, and running costs increase considerably.

In view of this situation, there is a need for a simplified mechanism for coordinated operation.

However, the propulsion apparatus 110 requires a drive source, and an engine that combusts liquid fuel is generally adopted as the drive source. A fuel tank is required to supply the fuel oil to the engine, and U.S. Pat. No. 3,171,383, for example, discloses a configuration in which a fuel tank is disposed in the hull 100. This example will be described with reference to FIG. 15.

A fuel tank 125 is disposed in the hull 100, as shown in FIG. 15. Fuel is fed to the engine using a fuel tube 126 from the fuel tank 125. The propulsion apparatus 110 turns in the manner indicated by the arrow (2) about the hull 100. The fuel tube 126 is loosely placed so as to provide an S-shaped form that allows displacement during a turn. Throttle cables 127, 128 that control the rotational speed of the engine are also loosely placed.

The area between the 100 and the propulsion apparatus 110 is unattractive and the external appearance is poor because the fuel tube 126 and throttle cables 127, 128 are present in a loose configuration between the hull 100 and the propulsion apparatus 110.

In view of this fact, there is a need to organize the area between the hull 100 and the propulsion apparatus 110 and improve the external appearance.

SUMMARY OF THE INVENTION

According to a first aspect of the present invention, there is provided a waterborne vehicle comprising a hull, a spindle that extends rearward from a rear portion of the hull; a bracket that is rotatably mounted about the shaft of the spindle, a propulsion apparatus that is steerably mounted to the bracket and propels the hull, and a steering mechanism that is disposed across the propulsion apparatus and the hull, and that transmits a tilt of the hull to steer the propulsion apparatus; wherein the steering mechanism has a first operation element that is mounted on the hull in a lower position than the spindle and that transmits the tilt of the hull; and a second operation element that is extended forward from the propulsion apparatus, has a distal end connected to the first operation element, and converts into steerage the tilt of the hull transmitted by the first operation element.

A steering mechanism can be embodied in a very simple structure by providing the first operation element in a lower position than the spindle.

Preferably, the first operation element is provided with a V-shaped groove that widens downward.

Desirably, the bottom and the opening of the V-shaped groove are circular arc portions, and the second operation element is a round rod.

It is preferred that the V-shaped groove open downward, the bracket be connected to the hull via a horizontal tilt shaft, and the round rod disengage from the V-shaped groove when the propulsion apparatus pivots about the tilt shaft from a service position to a standby position.

It is preferred that the spindle be a hollow shaft through which passes one of a throttle cable that extends from the hull to the propulsion apparatus and controls the rotational speed of an engine, and a fuel tube that supplies fuel to the engine.

According to a second aspect of the present invention, there is provided a waterborne vehicle comprising a hull, a spindle that extends rearward from a rear portion of the hull, and a propulsion apparatus that is steerably mounted about the axis of the spindle, wherein the spindle is a hollow shaft through which passes one of a throttle cable that extends from the hull to the propulsion apparatus and controls the rotational speed of an engine, and a fuel tube that supplies fuel to the engine.

The area between the hull and the propulsion apparatus can be organized and the external appearance can be improved when the throttle cable or the fuel tube is passed through the hollow shaft-form spindle.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
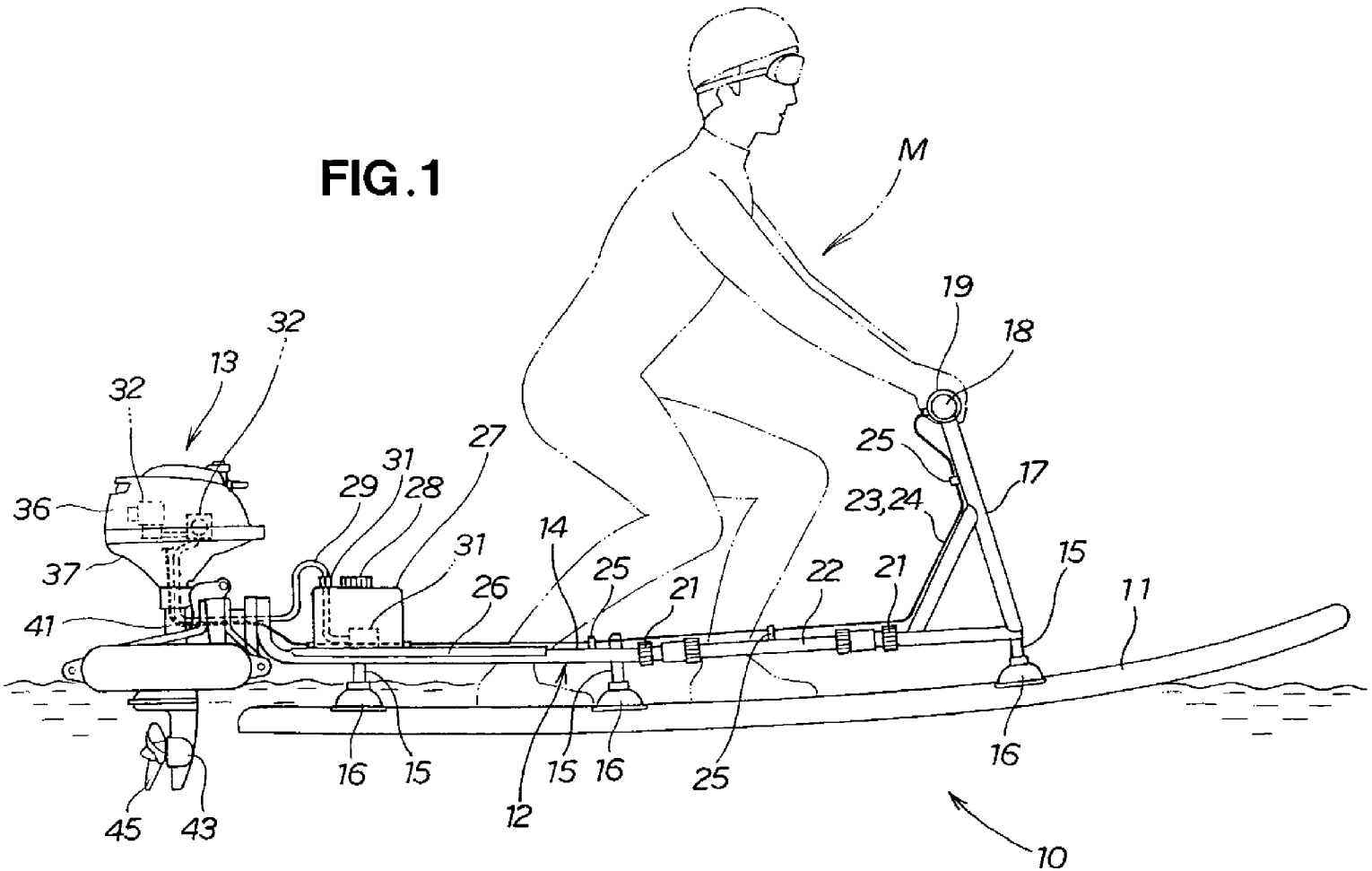
FIG. 1 is a side elevational view illustrating a waterborne vehicle according to the present invention.

A waterborne vehicle 10 comprises a hull 1, a frame 12 attached to the upper surface of the hull 11, and a propulsion apparatus 13 mounted on the frame 12, as shown in FIG. 1.

A plate-shaped board referred to as a surfboard can be used as the hull 11. The hull 11 may be a hollow body, a board provided with an engine, or an arbitrary shape.

The frame 12 is composed of a frame main body 14 in which pipes are assembled in the form of a well, leg portions 15 that are hung from the frame main body 14, a suction cup 16 provided to each of the leg portions 15, a stand portion 17 disposed on the front of the frame main body 14, a handle section 18 disposed on the upper end of the stand portion 17 and grasped by the rider M, and a throttle grip 19 disposed on the handle section 18. It is preferred that the frame main body 14 be divided by length-adjustment sections 22 to which lock nuts 21 are attached. The length (length in the left and right directions of the diagram) of the frame main body 14 can be modified by loosening the lock nuts 21 and then tightening the lock nuts 21 after modification, whereby the length of the frame main body 14 can be determined. The frame 12 can be mounted on hulls having different lengths when the length is adjustable.

The throttle cable 23 for opening a throttle valve, and the throttle cable 24 for closing the throttle valve extend from the throttle grip 19 to the interior of the propulsion apparatus 13. The throttle cables 23, 24 are disposed along the stand portion 17 and the frame main body 14, and are fixed in place by a plurality of fasteners 25 disposed on the stand portion 17 and the frame main body 14. The rider M rotates the throttle grip 19 to thereby increase forward propulsion and reduce the speed by returning the throttle to a lower setting.

A cross member 26 horizontally spans the rear portion of the frame main body 14, and a main fuel tank 27 is mounted on the cross member 26. Fuel is added to the main fuel tank 27 by opening a cap 28. A fuel tube 29 extends from the main fuel tank 27 to the interior of the propulsion apparatus 13. A strainer 31 is disposed at the distal end of the fuel tube 29, and the rear end of the fuel tube 29 is connected to a fuel pump 32. In other words, the fuel pump 32 is disposed inside the propulsion apparatus 13, and the fuel pump 32 suctions fuel through the fuel tube 29 and pressurizes and feeds the fuel to a carburetor 33.

Next, the structure of the propulsion apparatus 13, and the connecting structure between the frame 12 and the propulsion apparatus 13 will be described with reference to FIGS. 2 to 5.

Figure 2:
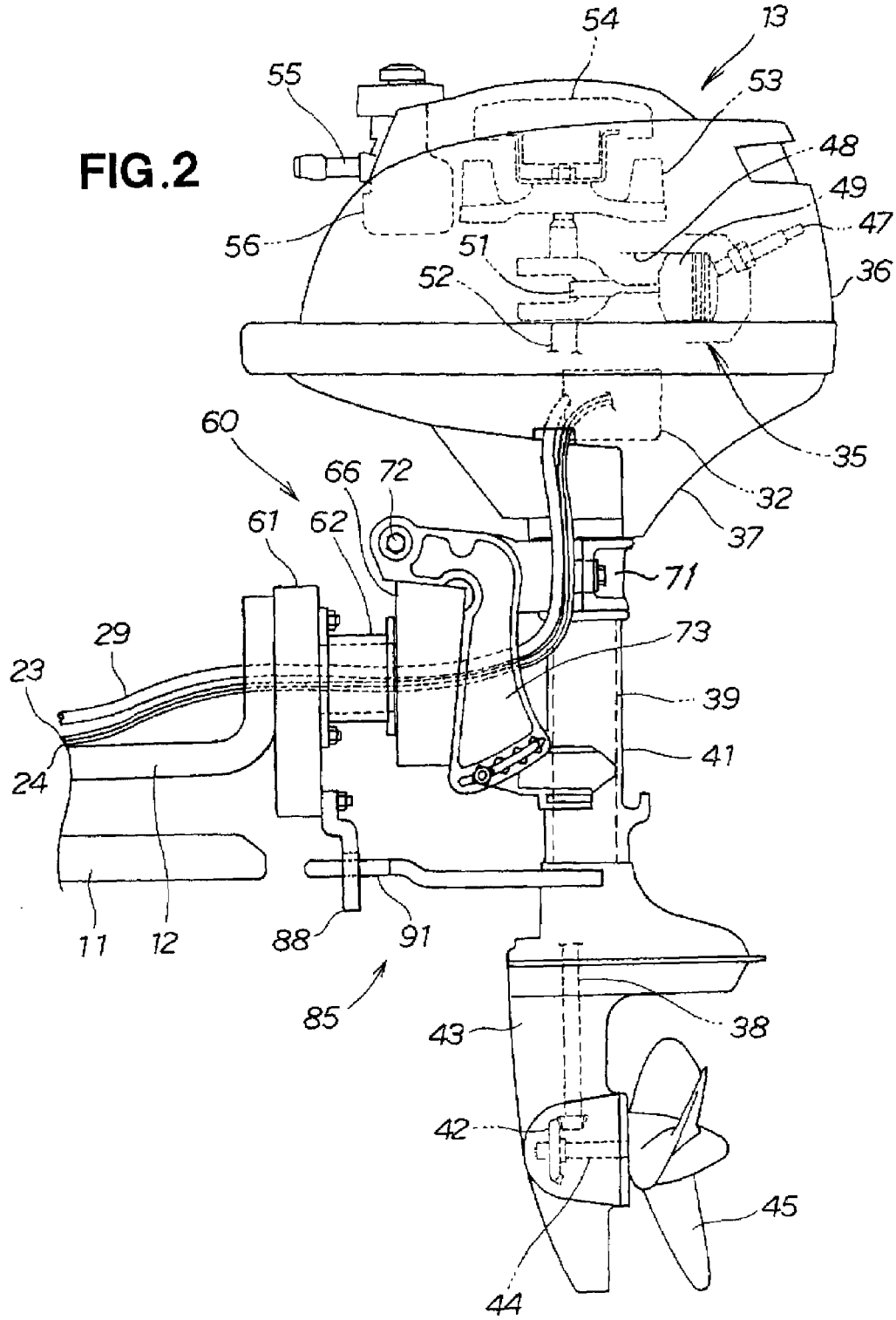
FIG. 2 is an enlarged view of a rear portion of the waterborne vehicle.

The propulsion apparatus 13 is preferably an apparatus referred to as an outboard motor, as shown in FIG. 2, and is composed of, e.g., an engine cover 36 that accommodates an engine 35, an under cover 37 joined from below to the engine cover 36, an extension case 39 (indicated by the broken line) that extends downward from the under cover 37 and accommodates a drive shaft 38 that is driven by the engine 35, a support outer cylinder 41 that accommodates and rotatably supports the extension case 39, a gear case 43 that is connected to the lower portion of the extension case 39 and accommodates a gear 42, a driven shaft 44 that extends horizontally from the gear case 43 and is driven by the drive shaft 38, and a propeller 45 disposed at the distal end of the driven shaft 44.

The engine 35 is composed of a cylinder 48 that is provided with a spark plug 47, a piston 49 accommodated in the cylinder 48, a crankshaft 52 in which the piston 49 is connected to a connecting rod 51 and whose axis is perpendicular thereto, a flywheel 53 disposed at the upper end of the crankshaft 52, and a coil starter mechanism 54 disposed on the flywheel 53. The coil starter mechanism 54 is a mechanism for manually starting the engine by pulling the start rope 55 that protrudes from the engine cover 36. A fuel reserve tank 56 is furthermore disposed in the engine cover 36. Fuel may also be fed to the engine 35 from the fuel reserve tank 56. Fuel is replenished from the main fuel tank 27, and stoppage of the engine 35 can be avoided by supplying fuel to the engine 35 when required.

Such a propulsion apparatus 13 is connected to the frame 12 using a connection mechanism 60. The structure of the connection mechanism 60 will be described with reference to FIG. 3.

Figure 3:
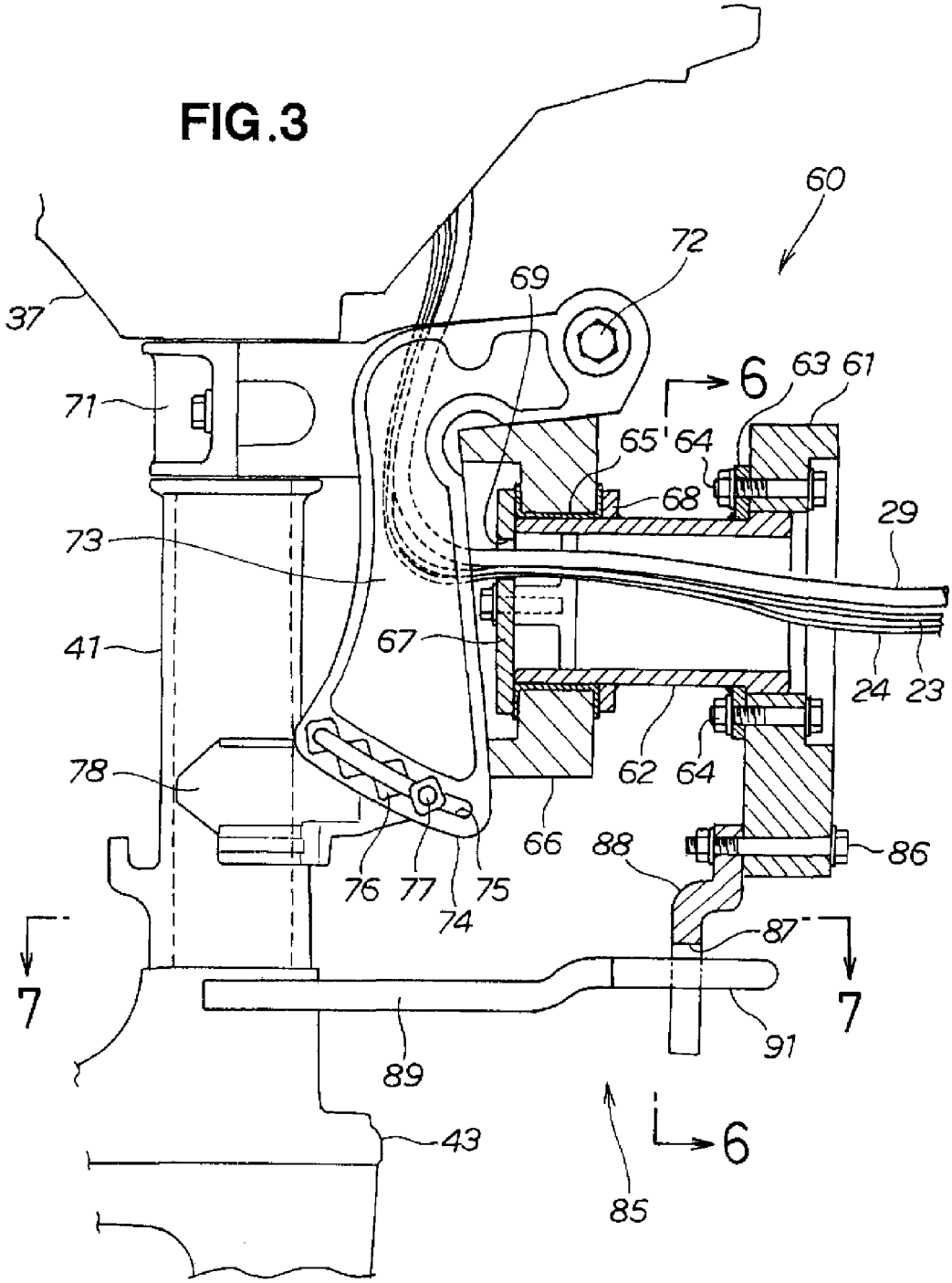
FIG. 3 is a left side elevational view showing a propulsion apparatus and a connecting mechanism.

As shown in FIG. 3, the connection mechanism 60 is composed of a base 61 fixed to the frame 12 (FIG. 2), a spindle 62 connected to the base 61, a bolt and nut 64 that fix a flange 63 disposed on the spindle 62 to the base 61, a support plate 66 which is provided with a metal piece 65 that covers the distal end (left side of the diagram) of the spindle 62 and which supports the propulsion apparatus 13, an end plate 67 disposed at the distal end of the spindle 62 so that the support plate 66 does not become dislodged, and a guard 68 that is disposed midway along the spindle 62 and that sandwiches the metal piece 65 against the end plate 67. With the support plate 66 in a fixed state, the spindle 62 and base 61 can be rotated because the metal piece 65 produces a sliding effect.

The spindle 62 is a hollow shaft, and a fuel tube 29 and throttle cables 23, 24 can be passed through the hollow portion. A small hole 69 sufficient to allow the fuel tube 29 and throttle cables 23, 24 to pass therethrough is provided to the end plate 67.

The brackets on the propulsion apparatus 13 will be described next.

Figure 4:
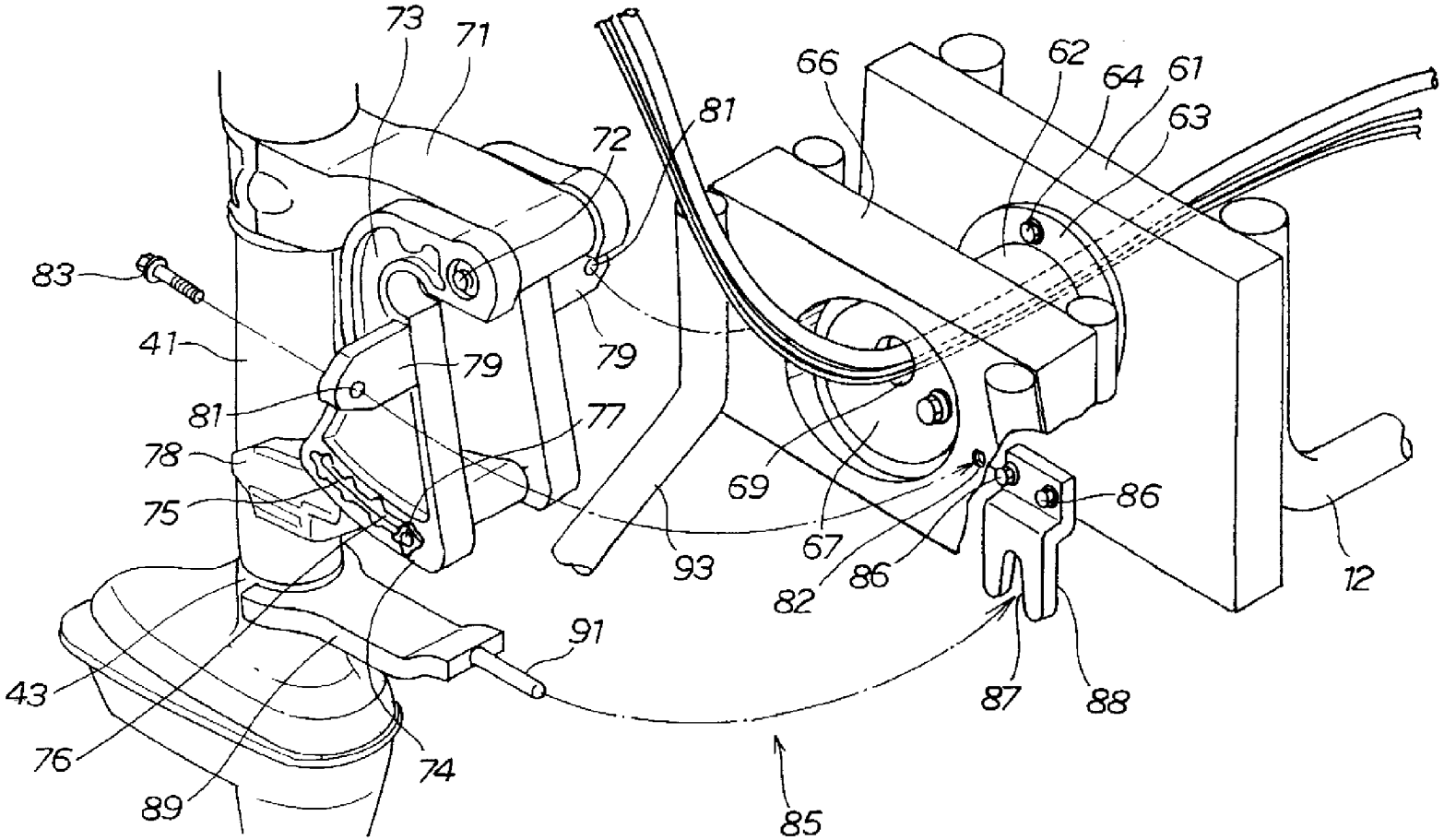
FIG. 4 is a schematic view showing a relationship between a stern bracket and a support plate.

A bracket 71 extends from the support outer cylinder 41 in the manner shown in FIG. 4. A stern bracket 73 is swingably mounted on the distal end of the bracket 71 via a tilt shaft 72. The lower portion of the stern bracket 73 is a sector-form portion 74, and a circular arc hole 75 is disposed in the sector-form portion 74 and has the tilt shaft 72 as its center. A plurality of square concave portions 76 is disposed at a prescribed pitch in the circular arc hole 75.

A square-headed square bolt 77 is mounted on the circular arc hole 75, and a stay 78 in the form of a horizontally long plate is supported by the square bolt 77.

Auricular small pieces 79, 79 are provided to the stern bracket 73, and bolt holes 81 are formed in the small pieces 79. Screw holes 82 that correspond to the bolt holes 81 are disposed in the support plate 66. The small pieces 79, 79 are brought into contact with the support plate 66, bolts 83 are passed through the bolt holes 81, and the bolts 83 are screwed into the screw holes 82 to thereby fix the stern bracket 73 to the support plate 66. In the manner described above, the propulsion apparatus 13 is mounted on the frame 12 via the connection mechanism 60, as shown in FIG. 2.

The side surface on the left side of support plate 66 in the diagram is inclined toward the perpendicular axis in the manner shown in FIG. 3. In other words, the stern of the hull is generally inclined.

The stern bracket 73 is mounted on the support plate 66, and the position of the stay 78 is subsequently determined. In other words, the stay 78 is set horizontally, and the head of the square bolt 77 is then fitted into the square concave portion 76. The stay 78 is thereby fixed to the stern bracket 73.

Next, the steering mechanism 85 will be described. The steering mechanism 85 is fixed to the lower portion of the base 61 using bolts 86, 86, and is composed of a first operation element 88 that is provided with a V-shaped groove 87 that opens and widens downward, and a second operation element 91 in the form of a round rod mounted at the distal end of a sub-bracket 89 that extends from the gear case 43, as shown in FIG. 4. The distal end of the second operation element 91 is inserted into the V-shaped groove 87.

Figure 5:
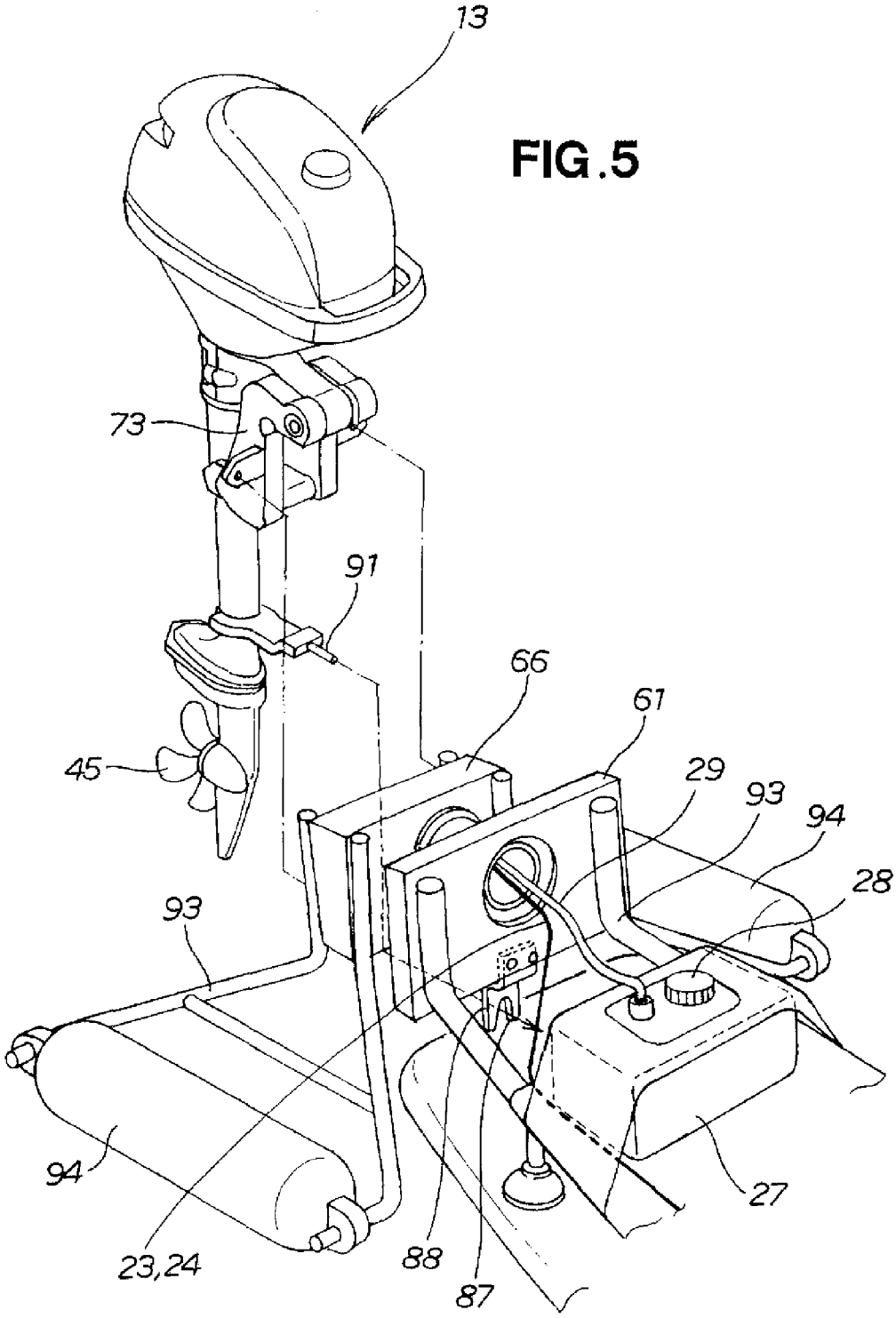
FIG. 5 is an exploded perspective view of the rear portion of the waterborne vehicle.

Specifically, the stern bracket 73 is fixed to the support plate 66, as shown in FIG. 5, and the distal end of the second operation element 91 is inserted into the V-shaped groove 87 of the first operation element 88. Stays 93, 93 made from pipes or round rods extend downward from the support plate 66, and floats 94, 94 are mounted on the stays 93, 93. The support plate 66 is held in a horizontal state when the floats 94, 94 are floating on water.

The operation of the first operation element 88 and second operation element 91 will be described next.

Figure 6:
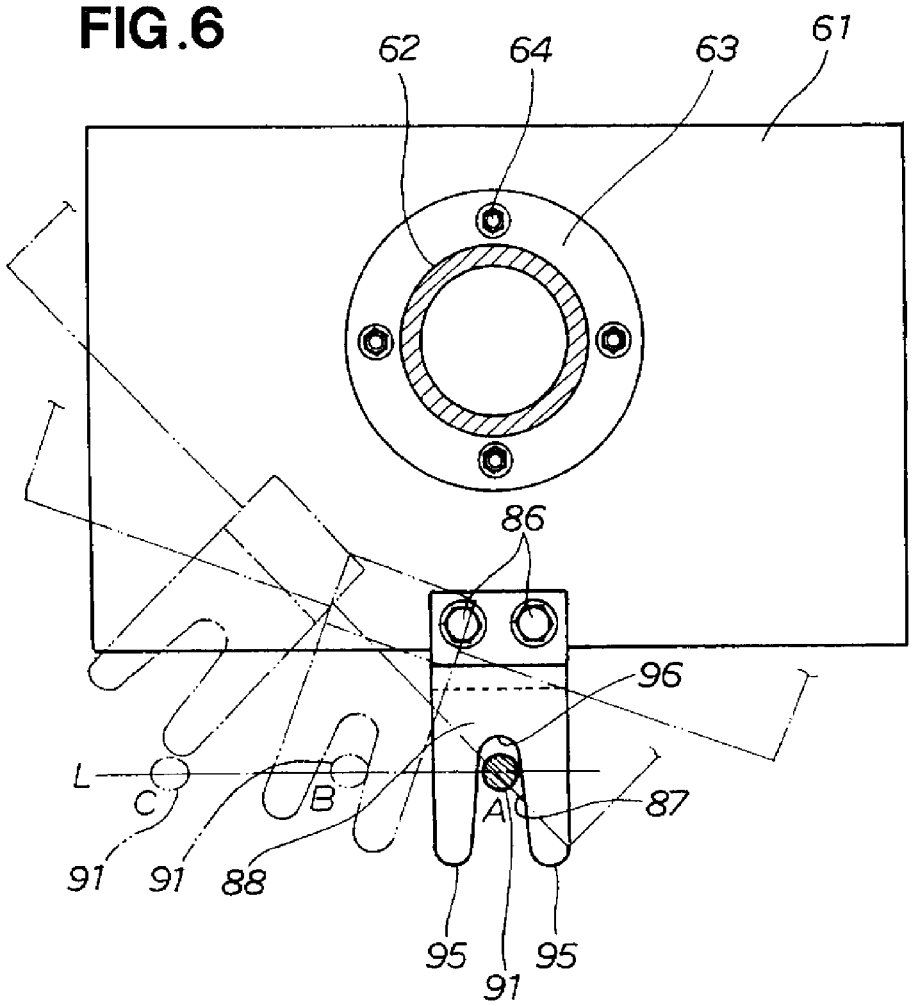
FIG. 6 is a cross-sectional view taken along line 6-6 of FIG. 3.

The first operation element 88 on the lower portion of the base 61 is provided with a V-shaped groove 87 and is disposed on both sides of the second operation element 91 in the manner of a two-pronged fork, as shown in FIG. 6. The second operation element 91 is held in position A if the base 61 is horizontal in the manner indicated by the solid line. The second operation element 91 moves to position B when the base 61 rotates in the clockwise direction of the diagram. The second operation element 91 moves along a horizontal path L. The second operation element 91 moves out from the V-shaped groove 87 indicated by the imaginary line and remains in position C when the base 61 rotates further in the clockwise direction of the diagram.

In other words, the second operation element 91 is engaged with the first operation element 88 until the base 61 tilts to fixed angle, but when the base 61 tilts beyond the fixed angle, the second operation element 91 separates from the first operation element 88 and becomes disengaged. The disengaged state limits the horizontal movement of the second operation element 91.

The second operation element 91 enters and exits the V-shaped groove 87 by moving from position C to position B, and from position B to position C. The entry and exit of the second operation element 91 are smoothly performed when circular arc portions 95, 95 are used as the entrance of the V-shaped groove 87, and such a configuration is preferred. Also, the bottom of the V-shaped groove 87 is also preferably a circular arc portion 96. The second operation element 91 in the form of a round rod can be smoothly accommodated when the bottom of the V-shaped groove is a circular portion 96.

Figure 7:
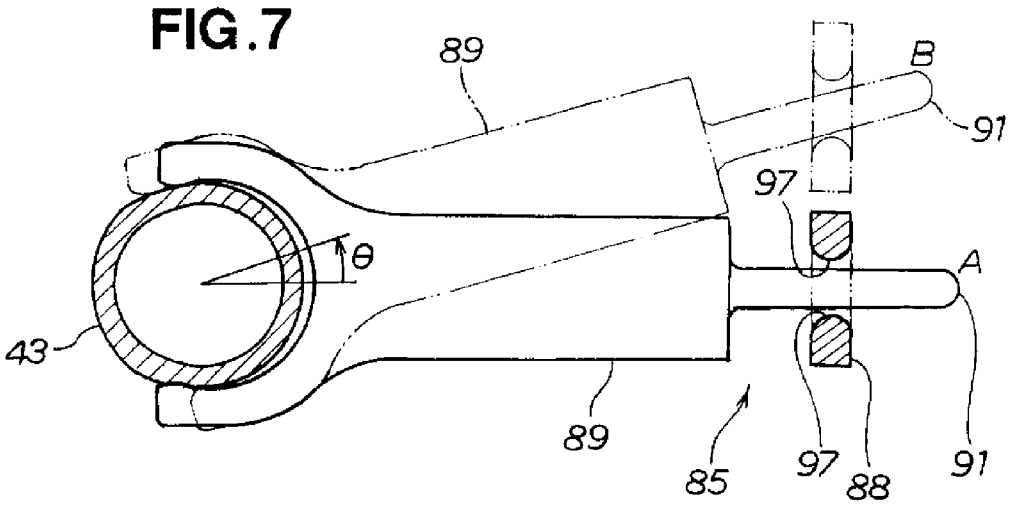
FIG. 7 is a cross-sectional view taken along line 7-7 of FIG. 3.

The movement of the second operation element 91 and the gear case 43 will be described with reference to FIG. 7. The second operation element 91 is in position A, as shown in FIG. 7. The second operation element 91 arrives at position B shown by an imaginary line when the first operation element 88 moves upward in the diagram. Since the gear case 43 can only rotate, the sub-bracket 89 indicated by the solid line pivots to the position indicated by the imaginary line. As a result, the gear case 43 rotates to an angle θ. The edge of the V-shaped groove (surface of contact with the second operation element 91) is preferably shaped as circular arc surfaces 97, 97.

Next, the operation of the steering mechanism 85 composed of the first operation element 88 and the second operation element 91 will be described with reference to FIGS. 8 to 10.

Figure 8:
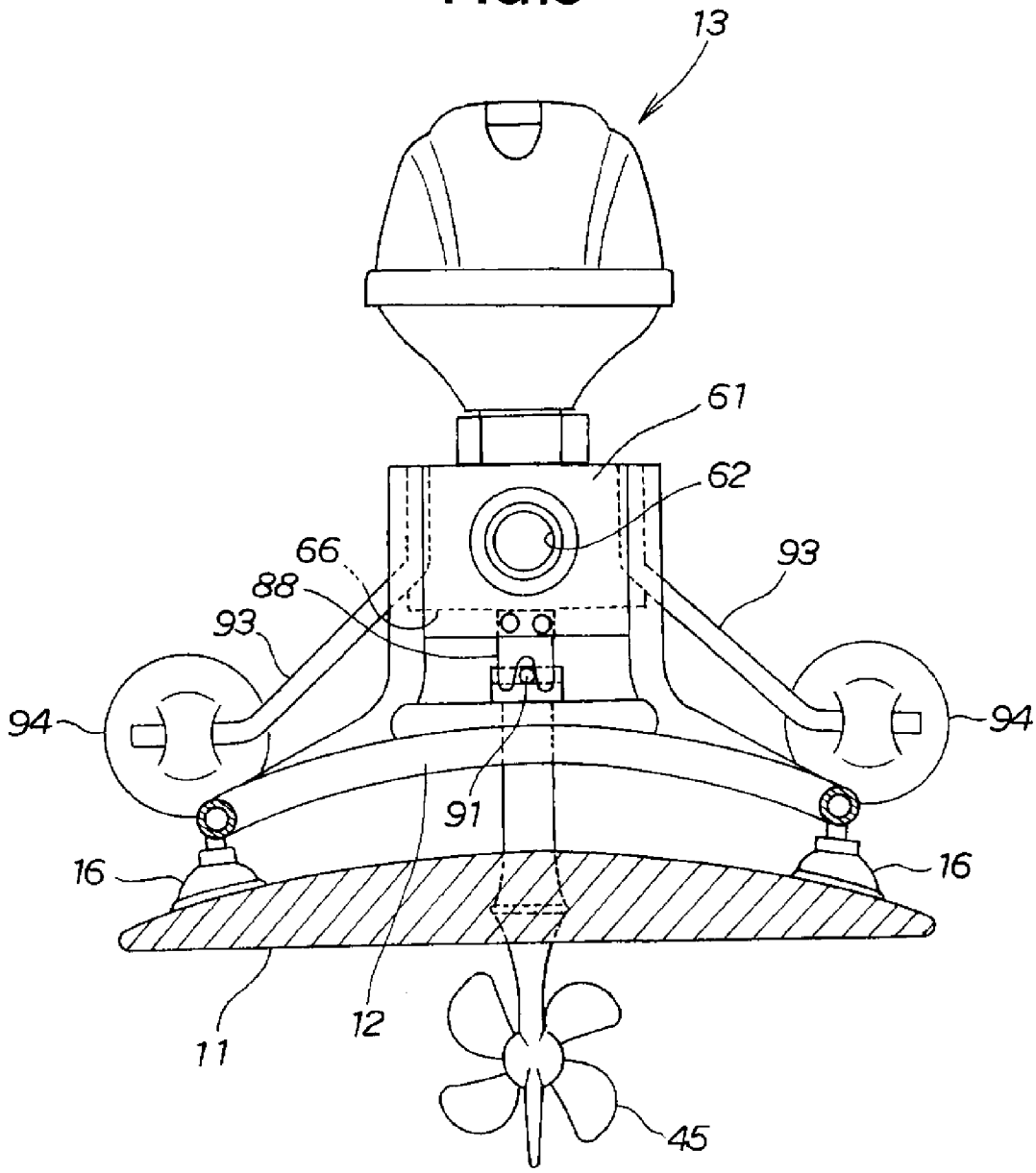
FIG. 8 is a front view of the waterborne vehicle during straight travel.

During propulsion, the hull 11 is held horizontally in the manner described in FIG. 8. The first operation element 88 faces directly downward, and the propeller 45 is oriented in the forward movement direction. Next, the hull 11 is tilted to the right in the diagram in accordance with the intent of the rider.

Figure 9:
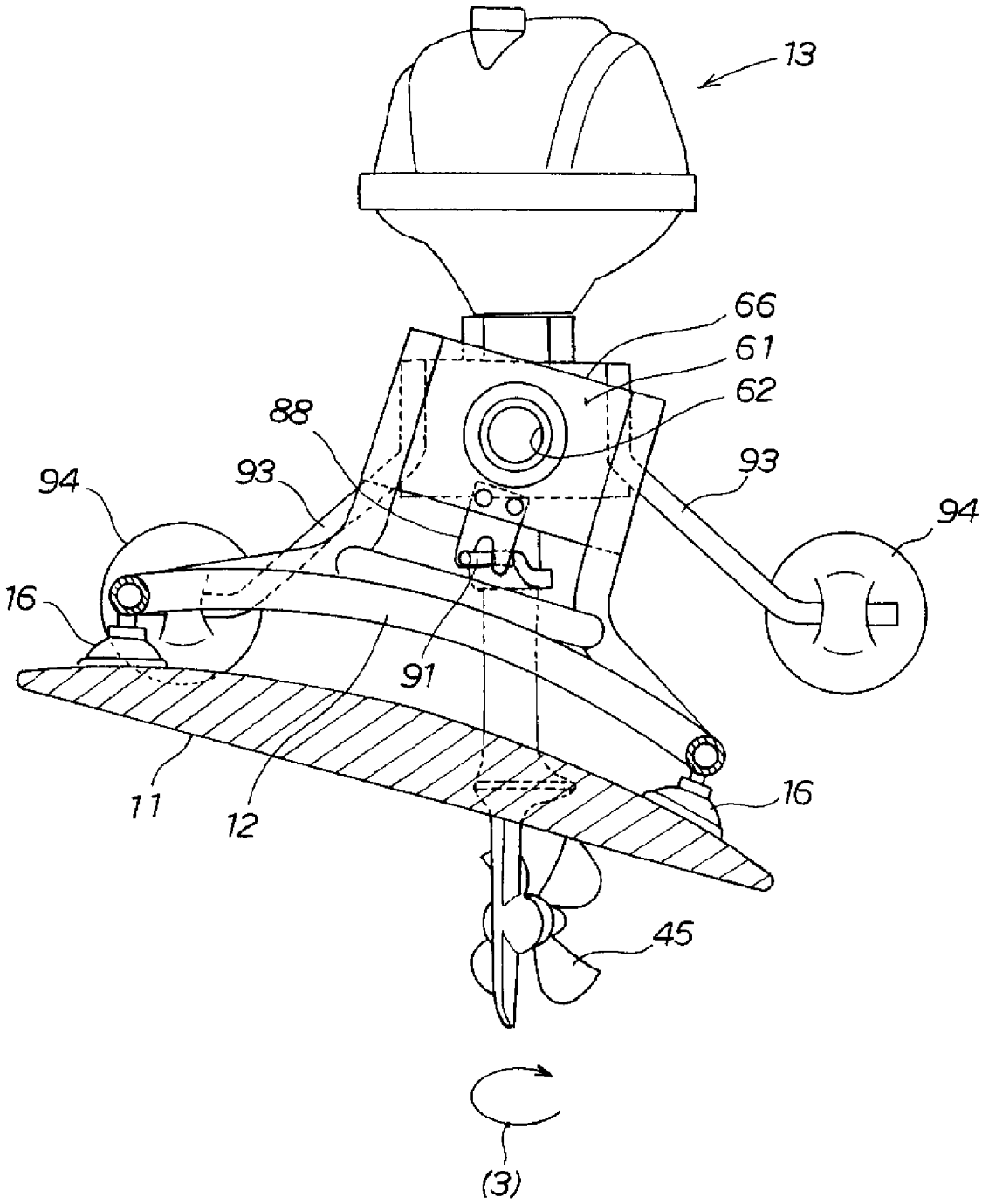
FIG. 9 is a front view of the waterborne vehicle during a right turn.

At this time, the first operation element 88 rotates in the clockwise direction in the diagram, as shown in FIG. 9, and the second operation element 91 is moved to the left in the diagram by the first operation element 88. The propulsion apparatus 13 turns in the manner indicated by the arrow (3), and the propeller 45 also turns in the same manner. Since the diagram is depicted from the front, the hull 11 turns to the left.

Next, the hull 11 is tilted to the left in the diagram in accordance with the intent of the rider.

Figure 10:
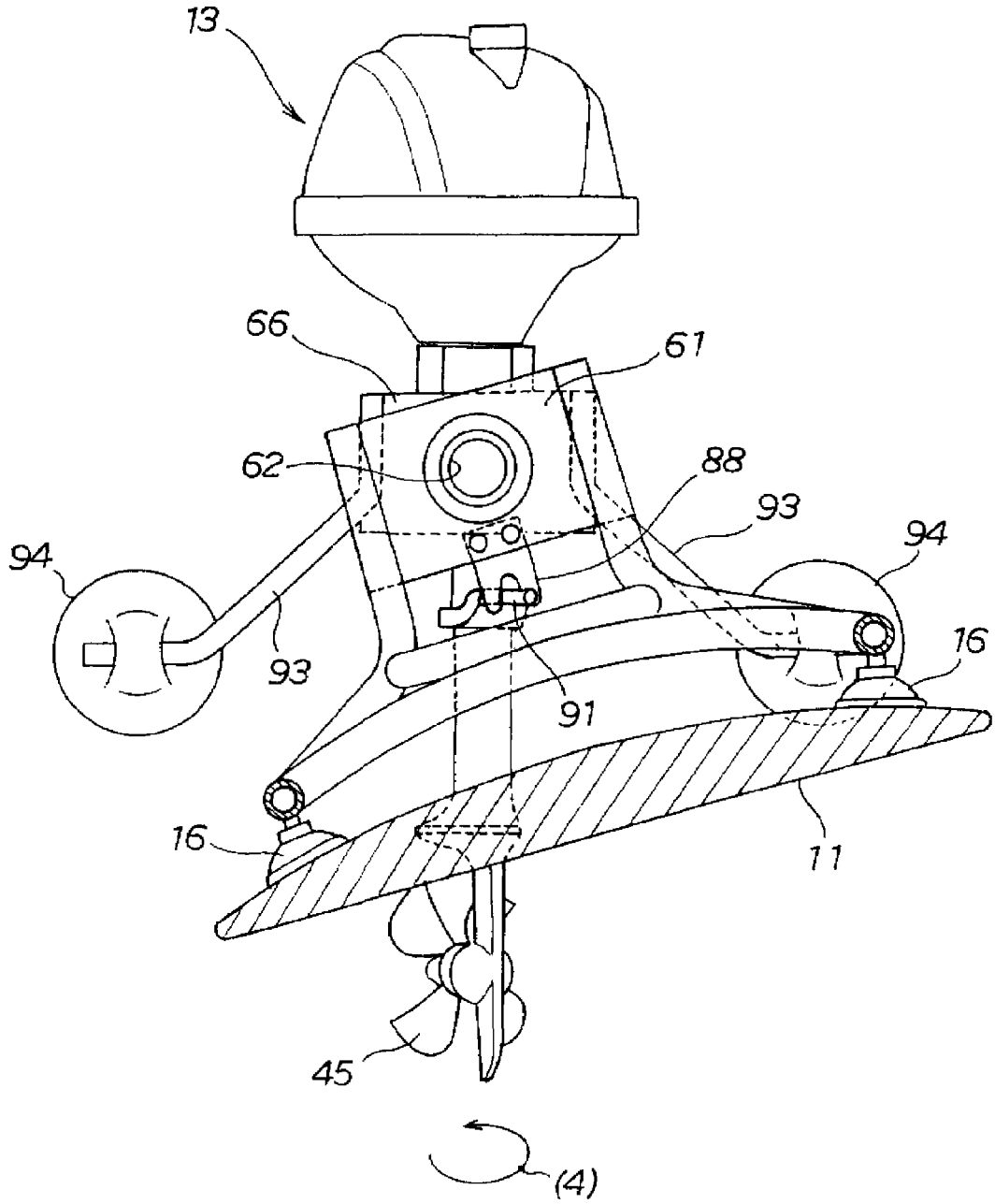
FIG. 10 is front view of the waterborne vehicle during a left turn.

At this time, the first operation element 88 rotates in the counterclockwise direction in the diagram, as shown in FIG. 10, and the second operation element 91 is moved to the right in the diagram by the first operation element 88. The propulsion apparatus 13 turns in the manner indicated by the arrow (4) and the propeller 45 also turns in the same manner. Since the diagram is depicted from the front, the hull 11 turns to the right.

The left or right turn operations described above are made possible because the first operation element 88 and the second operation element 91 are in a lower position than the spindle 62. The steering mechanism 85 composed of the first operation element 88 and the second operation element 91 has a very simple configuration, is disposed below the spindle 62, and is therefore inconspicuous, as shown in FIG. 3.

The fuel tube 29 and the throttle cables 23, 24, which have previously been exposed and been unsightly, are passed through the spindle 62 in the form of a hollow shaft, as shown in FIG. 3, and cannot be viewed from the exterior. An improvement in the external appearance can be achieved in this respect. Additionally, the center of the spindle 62 is the center of rotation of the hull 11. The amount of displacement that f the fuel tube 29 and the throttle cables 23, 24 are required to absorb can be reduced when the fuel tube 29 and the throttle cables 23, 24 are passed through such a center of rotation. As a result, the length of the fuel tube 29 and the throttle cables 23, 24 can be reduced.

When the propulsion apparatus 13 is an outboard motor, the propeller 45 becomes an obstruction when the waterborne vehicle is taken from the water and transported to a storage warehouse. In view of this situation, the propeller 45 must be tilted and placed in a non-obstructing position.

This tilt operation is described with reference to FIGS. 11 and 12.

Figure 11:
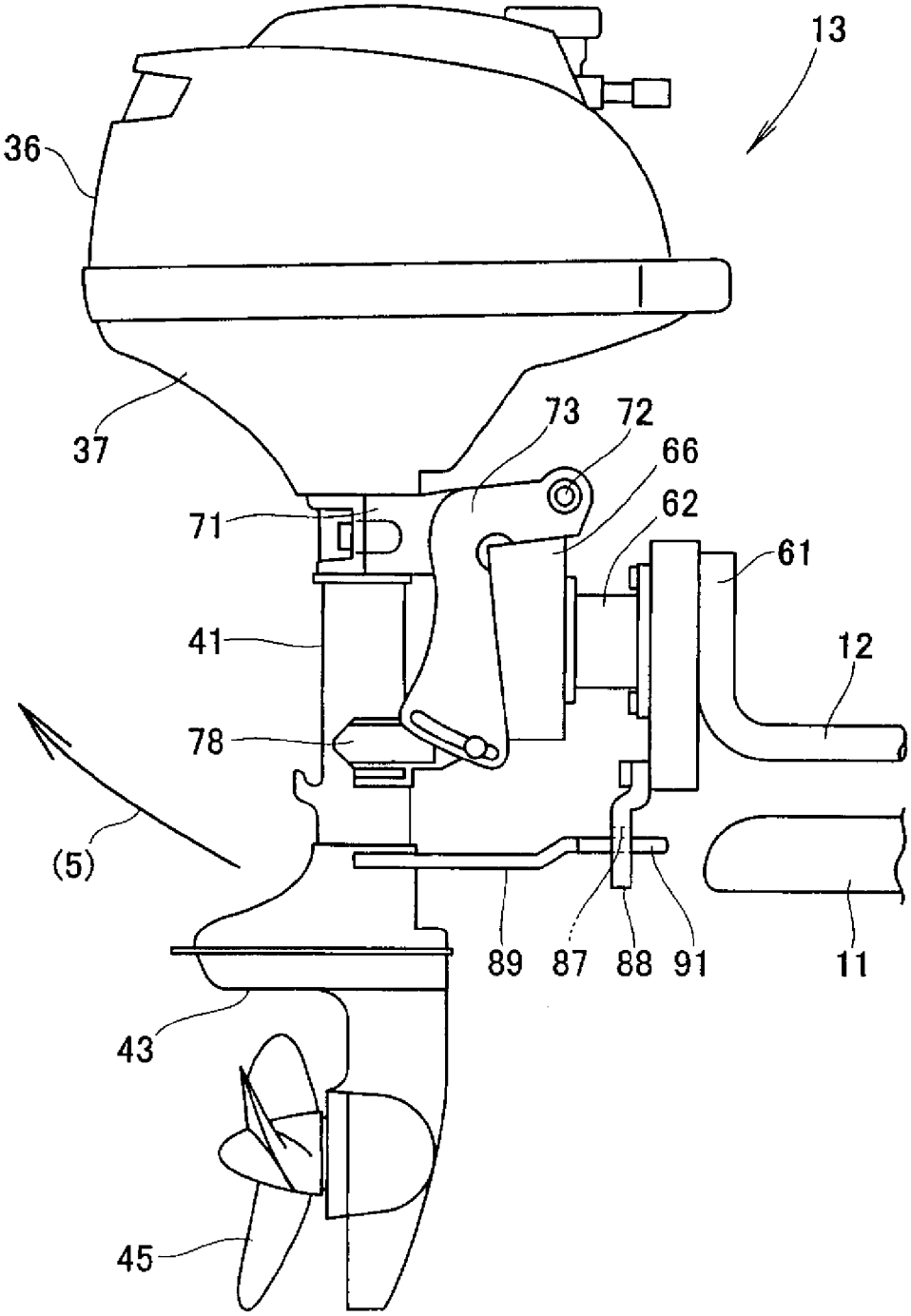
FIG. 11 is a view showing the state of the propulsion apparatus prior to tilting.
Figure 12:
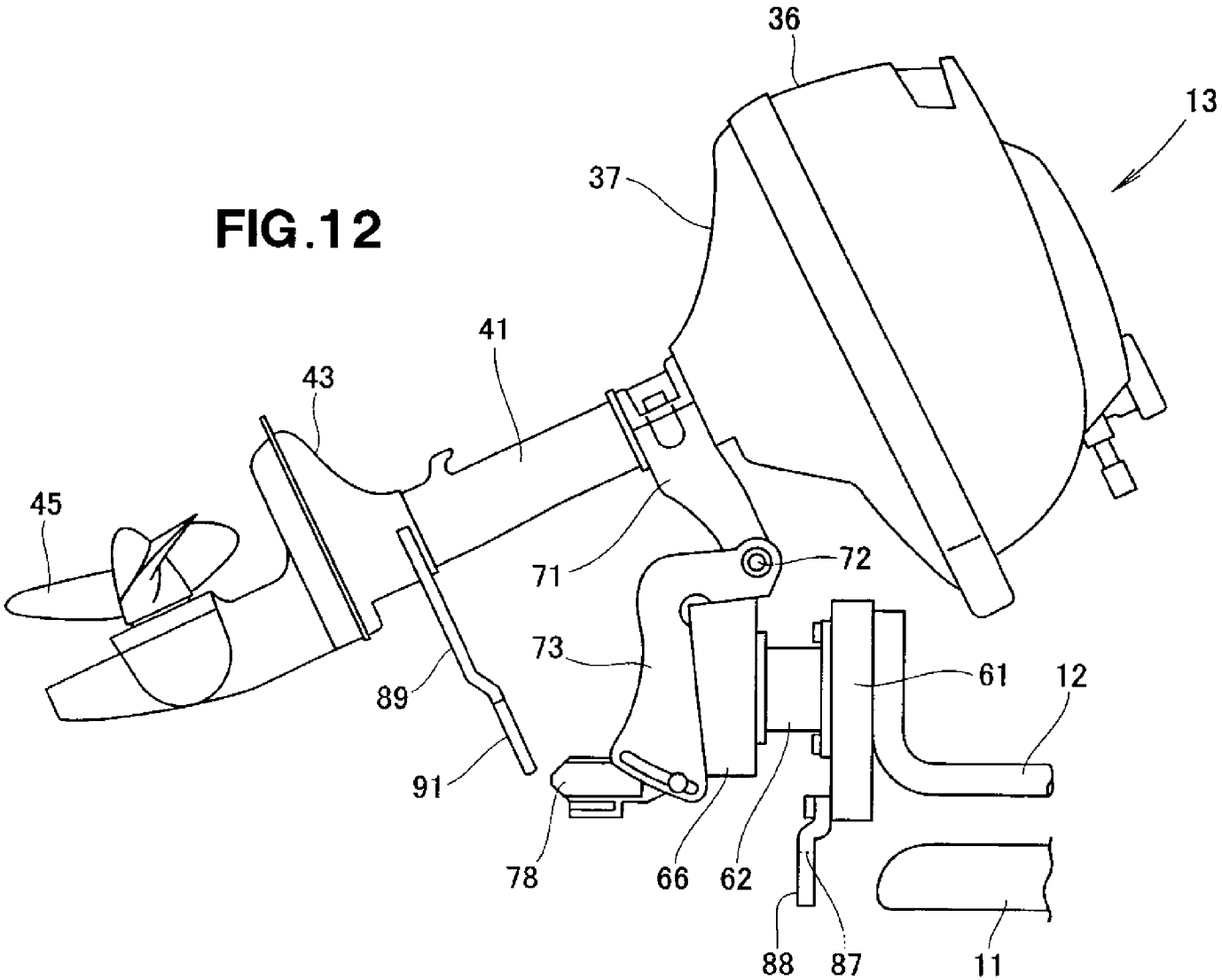
FIG. 12 is a view showing the state of the propulsion apparatus after tilting.
Figure 13:
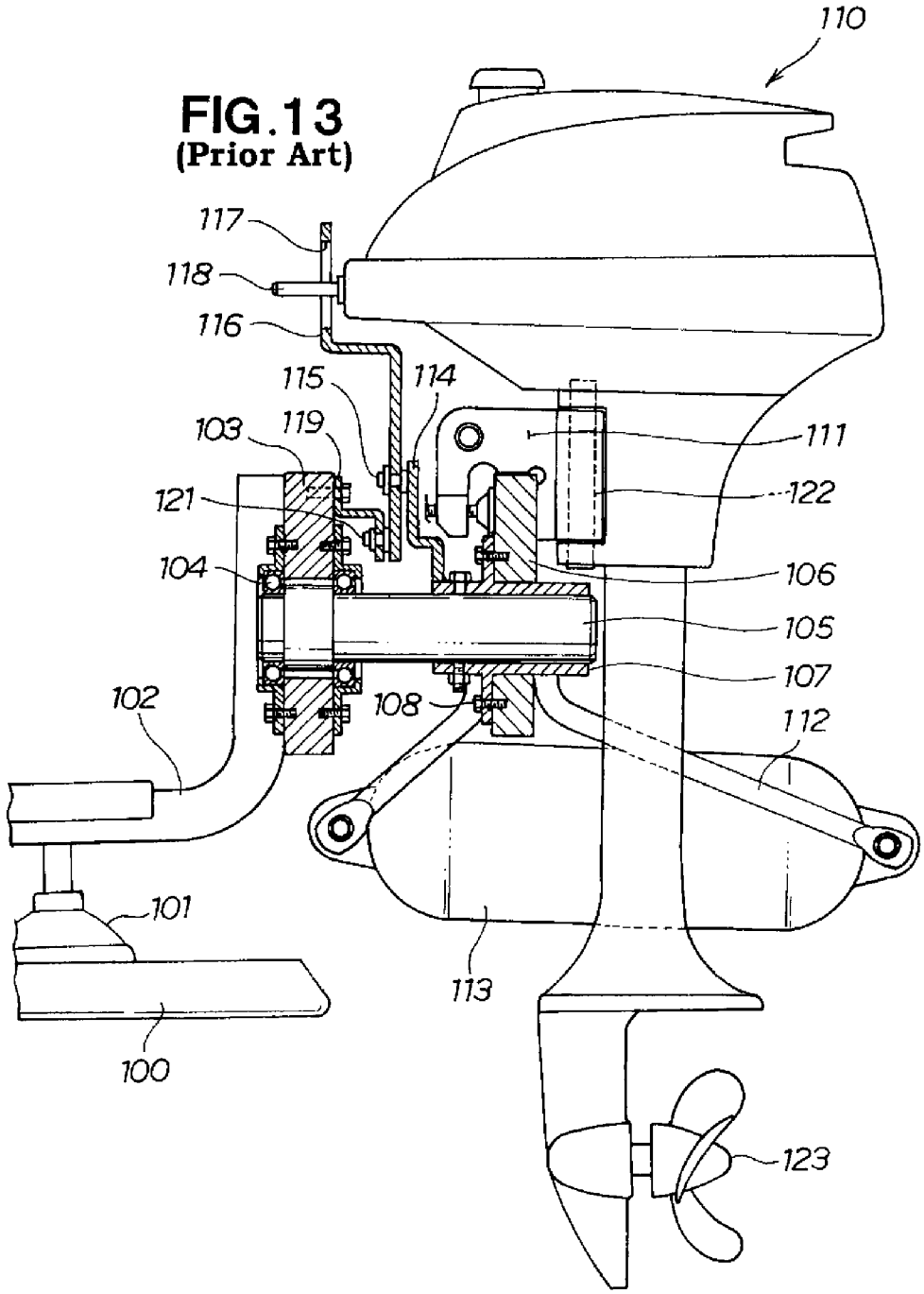
FIG.13 (Prior Art)
FIG. 13 is a right side view of a conventional propulsion apparatus.
Figure 14:
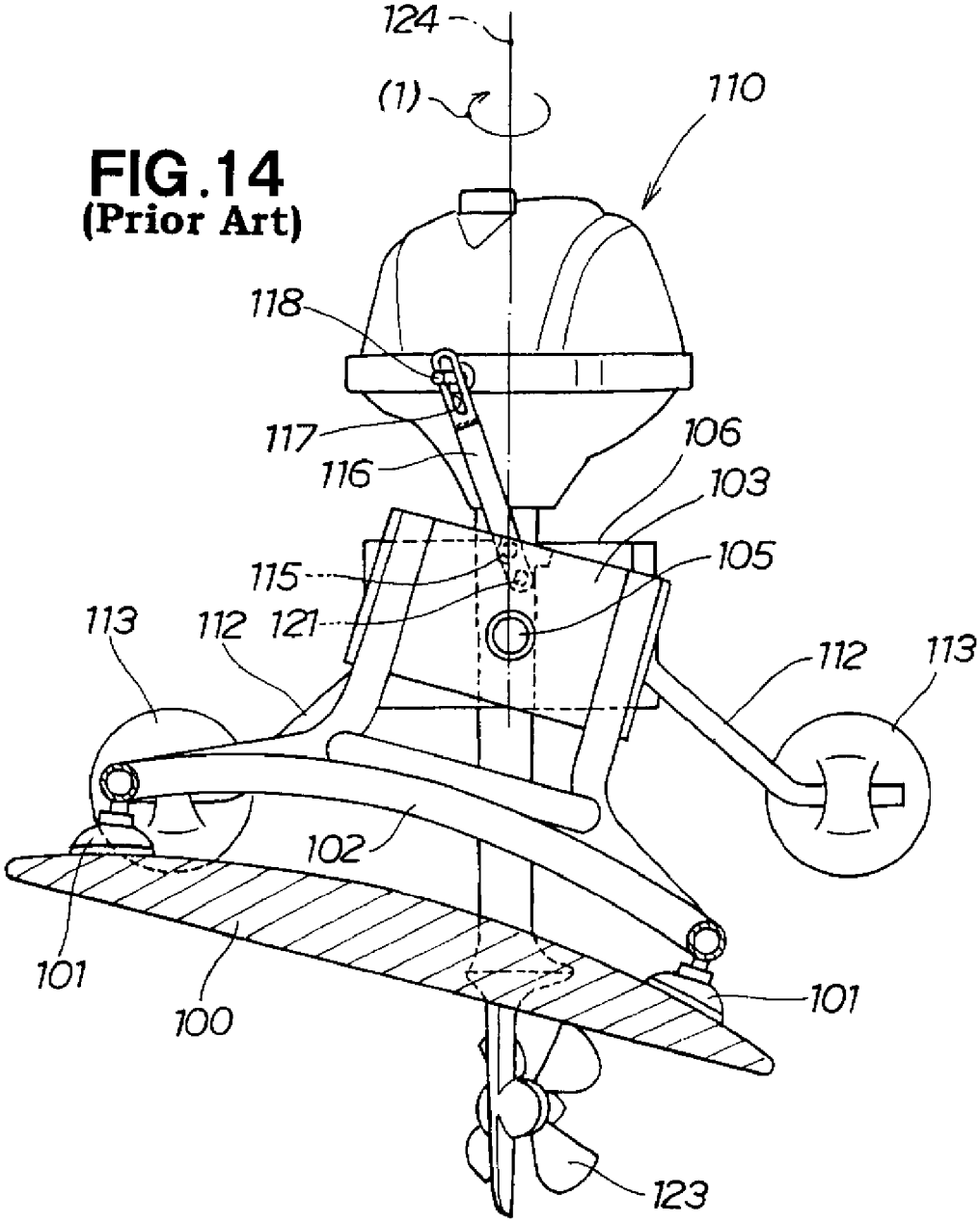
FIG.14 (Prior Art)
FIG. 14 is a schematic view illustrating the effect of the conventional propulsion apparatus.
Figure 15:
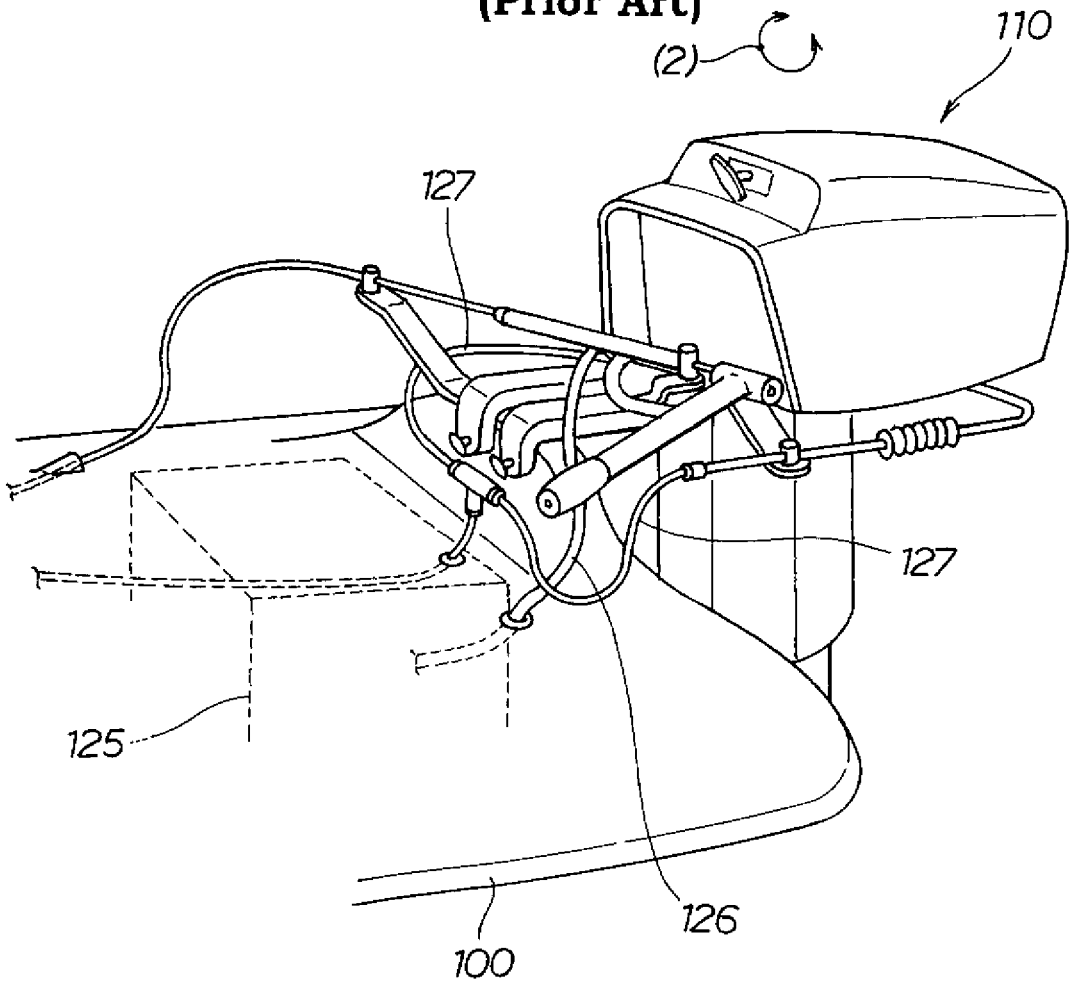
FIG.15 (Prior Art)
FIG. 15 is a perspective view of the rear portion of a conventional waterborne vehicle.

The propulsion apparatus 13 is disposed along the perpendicular axis when traveling on water, as shown in FIG. 11. It is apparent that the second operation element 91 is engaged at this time with the first operation element 88. With this tilt operation, the propulsion apparatus 13 is rotated about the tilt shaft 72 in the manner indicated by arrow (5). At this time, the support outer cylinder 41 separates from the stay 78, and the second operation element 91 is disengaged from the first operation element 88. The second operation element 91 is easily disengaged because the V-shaped groove 87 is open in the downward direction. As a result, the propeller 45 moves to a higher position than the hull 11, as shown in FIG. 12. This configuration is referred to as a tilted state. In this tilted state, there is no danger that the propeller 45 will make contact with the loading platform when the structure is loaded onto a transport truck.

The gear case 43 may make contact with the seabed or a submerged rock in the running state of FIG. 11. In this case as well, the propulsion apparatus 13 rotates about the tilt shaft 72 in the manner indicated by the arrow (5) and is placed in the tilted state of FIG. 12. As a result, damage to the gear case 43 and other components can be avoided.

The frame 12 shown in FIG. 1 may be directly mounted on the hull 11 without the suction cup 16. Also, the frame 12 may be discarded and the propulsion apparatus 13 or the like may be mounted directly on the hull 11.

Obviously, various minor changes and modifications of the present invention are possible in light of the above teaching. It is therefore to be understood that within the scope of the appended claims the invention may be practiced otherwise than as specifically described.

What is claimed is:

1. A waterborne vehicle comprising:

a hull;

a spindle extending rearward from a rear portion of the hull;

a bracket mounted rotatably about a shaft of the spindle;

a propulsion apparatus steerably mounted to the bracket for propelling the hull; and a steering mechanism, disposed across the propulsion apparatus and the hull, for transmitting a tilt of the hull to steer the propulsion apparatus, wherein the steering mechanism includes:

a first operation element that is mounted on the hull in a lower position than the spindle and that transmits the tilt of the hull; and a second operation element that is extended forward from the propulsion apparatus, has a distal end is connected to the first operation element, and converts into steerage the tilt of the hull transmitted by the first operation element.

2. The waterborne vehicle according to claim 1, wherein the first operation element is provided with a V-shaped groove that widens downward.

3. The waterborne vehicle according to claim 2, wherein a bottom and an opening of the V-shaped groove are circular arc portions, and the second operation element is a round rod.

4. The waterborne vehicle according to claim 3, wherein the V-shaped groove opens downward, the bracket is connected to the hull via a horizontal tilt shaft, and the round rod disengages from the V-shaped groove when the propulsion apparatus pivots about the tilt shaft from a service position to a standby position.

5. The waterborne vehicle according to claim 1, wherein the spindle is a hollow shaft through which passes one of a throttle cable that extends from the hull to the propulsion apparatus and controls the rotational speed of an engine, and a fuel tube that supplies fuel to the engine.

6. A waterborne vehicle comprising:

a hull;

a spindle extending rearward from a rear portion of the hull; and a propulsion apparatus steerably mounted about an axis of the spindle, wherein the spindle is a hollow shaft through which passes one of a throttle cable that extends from the hull to the propulsion apparatus and controls the rotational speed of an engine, and a fuel tube that supplies fuel to the engine.

* * * * *